US010208369B2

(12) United States Patent
Li et al.

(10) Patent No.: US 10,208,369 B2
(45) **Date of Patent: *Feb. 19, 2019**

(54) HIGH-HARDNESS LOW-ALLOY WEAR-RESISTANT STEEL SHEET AND METHOD OF MANUFACTURING THE SAME

(71) Applicant: BAOSHAN IRON & STEEL CO., LTD., Shanghai (CN)

(72) Inventors: Hongbin Li, Shanghai (CN); Liandeng Yao, Shanghai (CN); Guobin Song, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/649,684

(22) PCT Filed: Mar. 19, 2014

(86) PCT No.: PCT/CN2014/073680

§ 371 (c)(1),
(2) Date: Jun. 4, 2015

(87) PCT Pub. No.: WO2014/154106

PCT Pub. Date: Oct. 2, 2014

(65) Prior Publication Data

US 2016/0010191 A1 Jan. 14, 2016

(30) Foreign Application Priority Data

Mar. 28, 2013 (CN) ..... 2013 1 0105177

(51) Int. Cl.

| | |
|---|---|
| ***C22C 38/54*** | (2006.01) |
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/18*** | (2006.01) |

(Continued)

(52) U.S. Cl.

CPC ..... *C22C 38/54* (2013.01); *C21D 6/001* (2013.01); *C21D 6/002* (2013.01); *C21D 6/004* (2013.01); *C21D 6/005* (2013.01); *C21D 6/008* (2013.01); *C21D 8/021* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/46* (2013.01); *C22C 38/48* (2013.01); *C22C 38/50* (2013.01); *C21D 1/25* (2013.01); *C21D 2211/001* (2013.01); *C21D 2211/008* (2013.01)

(58) Field of Classification Search

CPC ..... C21D 1/25; C21D 2211/001; C21D 2211/008; C21D 6/001; C21D 6/002; C21D 6/004; C21D 6/005; C21D 6/008; C21D 8/021; C21D 8/0226; C21D 8/0263; C21D 9/46; C22C 38/001; C22C 38/002; C22C 38/005

See application file for complete search history.

(56) References Cited

U.S. PATENT DOCUMENTS

2011/0186670 A1* 8/2011 Town ..... B02C 17/225 241/182

FOREIGN PATENT DOCUMENTS

| | | |
|---|---|---|
| CN | 102134682 A | 7/2011 |
| CN | 102199737 A | 9/2011 |

(Continued)

OTHER PUBLICATIONS

PCT International Search Report, PCT/CN2014/073680, dated Jun. 30, 2014, 6 pages.

*Primary Examiner* — Jenny R Wu
(74) *Attorney, Agent, or Firm* — Quarles & Brady LLP

(57) ABSTRACT

A high-hardness low-alloy wear-resistant steel sheet and a method of manufacturing the same, which has the chemical compositions (wt %): C: 0.33-0.45%; Si: 0.10-0.50%; Mn: 0.50-1.50%; B: 0.0005-0.0040%; Cr: less than or equal to 1.50%; Mo: less than or equal to 0.80%; Ni: less than or equal to 2.00%; Nb: less than or equal to 0.080%; V: less than or equal to 0.080%; Ti: less than or equal to 0.060%; RE: less than or equal to 0.10%; W: less than or equal to 1.00%; Al: 0.010-0.080%, Ca: 0.0010-0.0080%, N: less than or equal to 0.0080%, O: less than or equal to 0.0080%, H: less than or equal to 0.0004%, P: less than or equal to 0.015%, S: less than or equal to 0.010%, and (Cr/5+Mn/6+50B): more than or equal to 0.20% and less than or equal to 0.50%; (Mo/3+Ni/5+2Nb): more than or equal to 0.02% and less than or equal to 0.50%; (Al+Ti): more than or equal to 0.01% and less than or equal to 0.13%, the remainders being Fe and unavoidable impurities. The steel sheet obtained from the above-mentioned chemical compositions and processes, has high hardness, excellent wear-resistant performance, and is applicable to a variety of parts in mechanical equipments extremely vulnerable to wearing.

13 Claims, 1 Drawing Sheet

(51) Int. Cl.

| | |
|---|---|
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 8/02*** | (2006.01) |
| ***C21D 6/00*** | (2006.01) |
| ***C21D 9/46*** | (2006.01) |
| ***C22C 38/08*** | (2006.01) |
| *C21D 1/25* | (2006.01) |

(56) References Cited

FOREIGN PATENT DOCUMENTS

| | | | | |
|---|---|---|---|---|
| CN | 102260829 | A | * | 11/2011 |
| CN | 102747282 | A | | 10/2012 |
| CN | 102876969 | A | | 1/2013 |
| CN | 102953016 | A | | 3/2013 |
| CN | 103205634 | A | | 7/2013 |
| JP | S6431928 | A | | 2/1989 |
| JP | 2002020837 | A | * | 1/2002 |
| JP | 2002080930 | A | | 3/2002 |
| JP | 2003129170 | A | | 5/2003 |
| JP | 2012031510 | A | | 2/2012 |

* cited by examiner

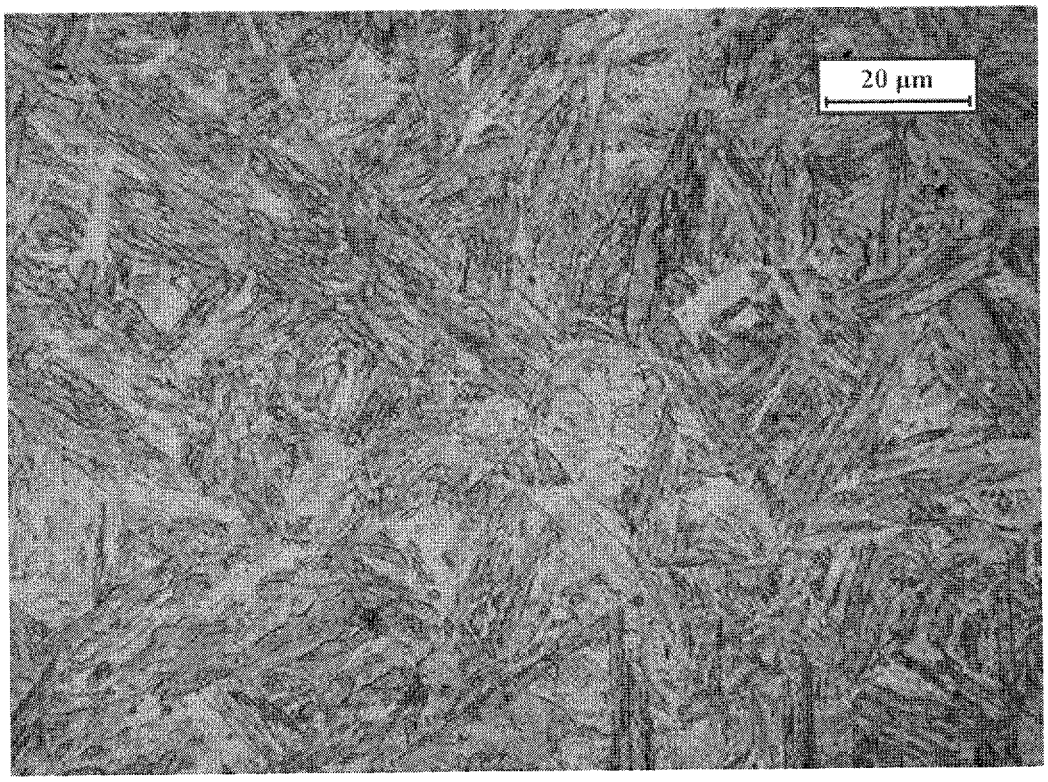
20 μm

HIGH-HARDNESS LOW-ALLOY WEAR-RESISTANT STEEL SHEET AND METHOD OF MANUFACTURING THE SAME

CROSS-REFERENCE TO RELATED APPLICATIONS

This application represents the national stage entry of PCT International Application No. PCT/CN2014/073680 filed Mar. 19, 2014, which claims priority of Chinese Patent Application No. 201310105177.3 filed Mar. 28, 2013, the disclosures of which are incorporated by reference here in their entirety for all purposes.

TECHNICAL FIELD

The present invention relates to wear-resistant steel and particularly, to a high-hardness low-alloy wear-resistant steel sheet and a method of manufacturing the same, which steel sheet has the typical mechanical properties: a hardness of more than 550HB, and −40° C. Charpy V-notch longitudinal impact energy of more than 40 J.

BACKGROUND

Wear-resistant steel sheets are widely applied on mechanical products in the field of projects with very serious operational conditions and requiring high strength and high wear-resistance, mining, agriculture, cement production, harbor, electrical power and metallurgy, such as earth mover, loading machine, excavator, dumper, grab bucket, stack-reclaimer, delivery bending structure, etc.

Traditionally, austenitic high-manganese steel are usually selected to manufacture the wear-resistant parts. Under the effect of large impact load, austenitic high-manganese steel may be strained to induce martensite phase transformation so as to improve the wear resistance thereof. Austenitic high-manganese steel are not suitable for wide application owing to the limitation of high alloy content, bad machining and welding performance, and low original hardness.

In the past decades, rapid development takes place in the exploitation and application of wear-resistant steel. It is usually produced by adding a moderate amount of carbon and alloy elements and through casting, rolling and offline heat treatment, etc. The casting way has the advantages of short work flow, simple process and easy production, but has the disadvantages of excessive alloy content, bad mechanical, welding and machining performances; the rolling way may further reduce the content of the alloy elements, and improve the performance of products thereof, but yet inappropriate for wide application; the heat treatments of offline quenching plus tempering are the main way of producing wear-resistant steel sheet, and the produced wear-resistant steel sheet has low alloy elements, and high performance and can make the industrial production stable. But with the higher requirements on low carbon, energy conservation, and environmental protection, products with low cost, short work flow and high performance, become the inevitable trend in the development of iron and steel industry.

China Patent CN1140205A discloses a wear-resistant steel with medium and high carbon and medium alloy, that is produced by casting, and has high contents of carbon and alloy elements (Cr, Mo, etc.), which results inevitably in bad mechanical properties and welding performance.

China Patent CN1865481A discloses a Bainite wear-resistant steel which has high contents of carbon and alloy elements (Si, Mn, Cr, Mo, etc.), thereby being of poor welding performance; and which is produced by air cooling after rolling or by stack cooling, thereby being of low mechanical properties.

SUMMARY

The objective of the present invention is to provide a high-hardness low-alloy wear-resistant steel sheet and a method of manufacturing the same, which steel sheet matches high hardness and high toughness on the basis of adding a small amount of alloy elements, and has good machining performance. It has the typical mechanical properties: a hardness of more than 550 HB, and −40° C. Charpy V-notch longitudinal impact energy of more than 40 J, very beneficial to the wide application on projects.

To achieve the above-mentioned objective, the present invention takes the following technical solution:

A high-hardness low-alloy wear-resistant steel sheet, which has the chemical compositions in weight percentage: C: 0.33-0.45%; Si: 0.10-0.50%; Mn: 0.50-1.50%; B: 0.0005-0.0040%; Cr: less than or equal to 1.50%; Mo: less than or equal to 0.80%; Ni: less than or equal to 2.00%; Nb: less than or equal to 0.080%; V: less than or equal to 0.080%; Ti: less than or equal to 0.060%; RE: less than or equal to 0.10%; W: less than or equal to 1.00%; Al: 0.010-0.080%; Ca: 0.0010-0.0080%; N: less than or equal to 0.0080%; O: less than or equal to 0.0080%; H: less than or equal to 0.0004%; P: less than or equal to 0.015%; S: less than or equal to 0.010%; and (Cr/5+Mn/6+50B): more than or equal to 0.20% and less than or equal to 0.50%; (Mo/3+Ni/5+2Nb): more than or equal to 0.02% and less than or equal to 0.50%; (Al+Ti): more than or equal to 0.01% and less than or equal to 0.13%, the remainders being Fe and unavoidable impurities; the microstructures thereof being fine martensite and retained austenite; the typical mechanical properties: a hardness of more than 550 HB, and −40° C. Charpy V-notch longitudinal impact energy of more than 40 J.

Further, RE is one or some of La, Ce, Nd.

The method of manufacturing the high-hardness low-alloy wear-resistant steel sheet, comprises the following stages:

smelting respective original materials as the aforementioned proportions of the chemical compositions, casting, heating, rolling and cooling directly after rolling to obtain the steel sheet; wherein in the heating stage, the slab heating temperature is 1000-1200° C., and the heat preservation time is 1-3 hours; in the stage of rolling, the rough rolling temperature is 900-1150° C., while the finish rolling temperature is 780-880° C.; in the stage of cooling, the steel is water cooled to below 400° C., then air cooled to the ambient temperature, wherein the speed of water cooling is more than or equal to 20° C./s.

Furthermore, the stage of cooling directly after rolling further includes a stage of tempering, in which the heating temperature is 100-400° C., and the heat preservation time is 30-120 min.

Preferably, during the heating process, the heating temperature is 1000-1150° C.; more preferably the heating temperature is 1000-1130° C.; and most preferably, the heating temperature is 1000-1110° C. for improving the production efficiency, and preventing the austenite grains from overgrowth and the surface of the billet from strongly oxidizing.

Preferably, in the stage of rolling, the rough rolling temperature is 900-1100° C., and the reduction rate in the stage of rough rolling is more than 20%, while the finish rolling temperature is 780-860° C., and the reduction rate in the stage of finish rolling is more than 40%; more preferably, the rough rolling temperature is 900-1080° C., and the reduction rate in the stage of rough rolling is more than 25%, while the finish rolling temperature is 780-855° C., and the reduction rate in the stage of finish rolling is more than 45%; most preferably, the rough rolling temperature is 910-1080° C., and the reduction rate in the stage of rough rolling is more than 28%, while the finish rolling temperature is 785-855° C., and the reduction rate in the stage of finish rolling is more than 50%.

Preferably, in the stage of cooling, the cease cooling temperature is below 380° C., the water cooling speed is more than or equal to 23° C./s; more preferably, the cease cooling temperature is below 350° C., the water cooling speed is more than or equal to 27° C./s; most preferably, the cease cooling temperature is below 330° C., and the water cooling speed is more than or equal to 30° C./s.

Preferably, in the stage of tempering, the heating temperature is 100-380° C. and the heat preservation time is 30-100 min; more preferably, the heating temperature is 120-380° C. the heat preservation time is 30-100 min; most preferably, the heating temperature is 150-380° C., the heat preservation time is 30-100 min.

The respective functionalities of the chemical compositions of the high-hardness low-alloy wear-resistant steel sheet according to the present invention are as follows:

Carbon: carbon is the most basic and important element in the wear-resistant steel, that can improve the strength and hardness of the steel, and thus further improve the wear resistance thereof. However it is not good for the toughness and welding performance of the steel. Accordingly, the carbon content in the steel should be controlled between 0.33-0.45 wt %, preferably, between 0.33-0.43 wt %.

Silicon: silicon is subjected to solid solution in ferrite and austenite, to improve their hardness and strength, but excessive silicon may result in sharply decreasing the toughness of the steel. Simultaneously, due to that the affinity between silicon and oxygen is better than that between the oxygen and Fe, it is easy to generate silicates with low melting point during welding, and increase the flowability of slag and melted metals, thereby affecting the quality of welding seams. Hence its content should not be too much. The silicon content in the wear-resistant steel of the present invention should be controlled between 0.10-0.60 wt %, preferably, between 0.10-0.50 wt %.

Manganese: manganese improves sharply the hardenability of the steel, and reduces the transformation temperature and critical cooling speed thereof. However, when the content of manganese is too high, it may have a grain coarsening tendency, increasing the susceptibility to tempering embrittleness and prone to causing segregation and cracks of casting blanks, thus lowering the performance of the steel sheet. The manganese content in the wear-resistant steel of the present invention should be controlled between 0.50-1.50 wt %, preferably, between 0.50-1.20 wt %.

Boron: boron can improve the hardenability of steel, but excessive boron may result in hot shortness, and affect the welding performance and hot machining performance. Consequently, it is necessary to control the content of B. The content of B in the wear-resistant steel is controlled between 0.0005-0.0040 wt %, preferably, between 0.0005-0.0020 wt %.

Chromium: chromium can decrease the critical cooling speed and improve the hardenability of the steel. Chromium may form multiple kinds of carbides such as $(Fe,Cr)_3C$, $(Fe,Cr)_7C_3$ and $(Fe,Cr)_{23}C_7$, that can improve the strength and hardness. During tempering, chromium can prevent or retard the precipitation and aggregation of carbide, and improve the temper stability. The chromium content in the wear-resistant steel of the present invention should be controlled less than or equal to 1.50 wt %, preferably, between 0.10-1.30%.

Molybdenum: molybdenum can refine grains and improve the strength and toughness. Molybdenum exists in the sosoloid phase and carbide phase of the steel, hence, the steel containing molybdenum has effects of solid solution and carbide dispersion strengthening. Molybdenum is the element that can reduce the temper brittleness, with improving the temper stability. The molybdenum content in the wear-resistant steel of the present invention should be controlled less than or equal to 0.80 wt %, preferably less than or equal to 0.60% wt %.

Nickel: nickel can reduce the critical cooling speed, and improve the hardenability. Nickel is mutually soluble with ferrum in any ratio, and improves the low-temperature toughness of the steel through refining the ferrite grains, and has the effect of obviously decreasing the cold shortness transformation temperature. For the high level wear-resistant steel with high low-temperature toughness, nickel is a very beneficial additive element. However, excessive nickel may lead to the difficulty of descaling on the surface of the steel sheet and remarkably higher cost. The nickel content in the wear-resistant steel of the present invention should be controlled less than or equal to 2.00 wt %, preferably less than or equal to 1.50 wt %.

Niobium: the effects of refining grains and precipitation strengthening of niobium contribute notably to the obdurability of the material, and Nb is the strong former of carbide and nitride which can strongly restrict the growth of austenite grains. Nb improves or enhances the performance of the steel mainly through precipitation strengthening and phase transformation strengthening, and it has been considered as one of the most effective hardening agent in the HSLA steel. The niobium content in the wear-resistant steel of the present invention should be controlled less than or equal to 0.080 wt %, preferably between 0.005-0.080 wt %.

Vanadium: the addition of vanadium is to refine grains, to make the austenite grains free from too coarsening during heating the steel blank. Thus, during the subsequent multi-pass rolling, the steel grains can be further refined and the strength and toughness of the steel are improved. The vanadium content in the wear-resistant steel of the present invention should be controlled less than or equal to 0.080 wt %, preferably less than or equal to 0.060 wt %.

Aluminum: aluminum and nitrogen in the steel may form fine and indissolvable AlN particles, which can refine the grains in the steel. Aluminum can refine the grains in the steel, stabilify nitrogen and oxygen in the steel, alleviate the susceptibility of the steel to the notch, reduce or eliminate the ageing effect and improve the toughness thereof. The content of Al in the wear-resistant steel is controlled between 0.010-0.080 wt %, preferably, between 0.020-0.080 wt %.

Titanium: titanium is one of the formers of strong carbide, and forms fine TiC particles together with carbon. TiC particles are fine, and distributed along the grain boundary, that can reach the effect of refining grains. Harder TiC particles can improve the wear resistance of the steel. The content of titanium in the wear-resistant steel is controlled less than or equal to 0.060 wt %, preferably, between 0.005-0.060 wt %.

Aluminum and titanium: titanium can form fine particles and further refine grains, while aluminum can ensure the formation of fine Ti particles and allow full play of titanium to refine grains. Accordingly, the range of the total content of aluminum plus titanium should be controlled more than or equal to 0.010% and less than or equal to 0.13%, preferably, more than or equal to 0.010% and less than or equal to 0.12%.

Rare earth: the addition of a trace of rare earth can reduce the segregation of elements such as phosphorus and sulphur, to enhance the shape, size and distribution of nonmetal inclusions, and at the same time can refine grains to improve the hardness. Rare earth can increase the yield/strength ratio and benefit for improving the obdurability of the high-strength low-alloy steel. There should not be excessive rare earth, or otherwise may cause serious segregation, to decrease the quality and mechanical properties of casting blank. The content of rare earth in the wear-resistant steel of the present invention should be controlled less than or equal to 0.10 wt %, preferably, less than or equal to 0.08 wt %.

Tungsten: tungsten can improve the tempering stability and hot strength of the steel, and can has a certain effect of refining grains. Furthermore, tungsten can form hard carbides to improve the wear resistance. The content of tungsten in the wear-resistant steel of the present invention should be controlled less than or equal to 1.00 wt %, preferably, less than or equal to 0.80 wt %.

Calcium: calcium contributes remarkably to the deterioration of the inclusions in the cast steel, and the addition of an appropriate amount of calcium in the cast steel may transform the strip like sulfide inclusions into spherical CaS or (Ca, Mn) S inclusions. The oxide and sulfide inclusions formed by calcium have low density and tend to float and to be removed. Calcium also reduces the segregation of sulfide at the grain boundary notably. All of those are beneficial to improve the quality of the cast steel, and further improve the performance thereof. The content of calcium in the wear-resistant steel is controlled between 0.0010-0.0080 wt %, preferably, between 0.0010-0.0050 wt %.

Phosphorus and sulphur: both phosphorus and sulphur are harmful elements in the wear-resistant steel, and the content thereof should be controlled strictly. The content of phosphorus in the steel of the present invention is controlled less than or equal to 0.015 wt %, preferably less than or equal to 0.012 wt %; the content of sulphur therein controlled less than or equal to 0.010 wt %, preferably less than or equal to 0.005 wt %.

Nitrogen, oxygen and hydrogen: excessive nitrogen, oxygen and hydrogen in the steel is harmful to the performances such as welding performance, impact toughness and crack resistance, and may reduce the quality and lifetime of the steel sheet. But too strict controlling may substantially increase the production cost. Accordingly, the content of nitrogen in the steel of the present invention is controlled less than or equal to 0.0080 wt %, preferably less than or equal to 0.0050 wt %; the content of oxygen therein controlled less than or equal to 0.0080 wt %, preferably less than or equal to 0.0050 wt %; the content of hydrogen therein controlled less than or equal to 0.0004 wt %, preferably less than or equal to 0.0003 wt %.

Due to the scientifically designed contents of carbon and alloy elements in the high-hardness low-alloy wear-resistant steel sheet of the present invention, and through the refinement strengthening effects of the alloy elements and controlling the rolling and cooling process for structural refinement and strengthening, the obtained wear-resistant steel sheet has excellent mechanical properties (hardness, impact toughness, etc.) and wearing resistance, achieving the match of super hardness and high toughness.

Comparing to the prior art, the high-hardness low-alloy wear-resistant steel sheet of the present invention has the following features:

1. regarding the chemical compositions, the wear-resistant steel sheet of the present invention gives priority to low carbon and low alloy, and makes full use of the characteristics of refinement and strengthening of the micro-alloy elements such as Nb, Ti or the like, reducing the contents of carbon and alloy elements such as Cr, Mo, and Ni, and ensuring the good mechanical properties of the steel sheet.

2. regarding the production process, the wear-resistant steel sheet of the present invention is produced by TMCP process, and through controlling the process parameters such as start rolling and finish rolling temperatures, rolling deformation amount, and cooling speed in the TMCP process, the structure refinement and strengthening effects are achieved, and further the contents of carbon and alloy elements are reduced, thereby obtaining the steel sheet with excellent mechanical properties, etc. Moreover, the process has the characteristics of short work flow, high efficiency, energy conservation and low cost etc.

3. regarding the performance of the products, the wear-resistant steel sheet of the present invention has the advantages such as high hardness, high low-temperature toughness (typical mechanical properties thereof: Brinell Hardness of more than 550HB, and −40° C. Charpy V-notch longitudinal impact energy of more than 50 J), and has good wearing resistance.

4. regarding the micro-structure, the wear-resistant steel sheet of the present invention makes full use of the combination of the alloy elements and the controlled rolling and controlled cooling processes, to obtain fine martensite structures and retained austenite (wherein the volume fraction of the retained austenite is less than or equal to 5%), which are beneficial for matching nicely the strength, hardness and toughness of the wear-resistant steel sheet.

In sum, the wear-resistant steel sheet of the present invention has apparent advantages, and owing to being obtained by controlling the content of carbon and alloy elements and the heat treatment processes, it is of low cost, high hardness, good low-temperature toughness, and applicable for a variety of parts in mechanical equipments extremely vulnerable to wearing, whereby this kind of wear-resistant steel sheet is the natural tendency of the development of the social economy and iron-steel industries.

BRIEF DESCRIPTION OF THE DRAWINGS

FIG. 1 is a photograph of the microstructure of the steel sheet in Embodiment 7 according to the present invention.

DETAILED DESCRIPTION

Hereinafter the technical solution of the present invention will be further set out in conjunction with the detailed embodiments. It should be specified that those embodiments are only used for describing the detailed implements of the present invention, but not for constituting any limitation on the protection scope thereof.

Table 1 shows the chemical compositions in weight percentage of the wear-resistant steel sheet in Embodiments 1-10 and the steel sheet in the contrastive example 1 (which is an embodiment in the patent CN1140205 A). The method of manufacturing them is: the respective smelt raw materials are treated in the following stages: smelting—casting—heating—rolling—cooling directly after rolling—tempering (not necessary), and the chemical elements in weight percentage are controlled, wherein, in the stage of heating, the slab heating temperature is 1000-1200° C., and the hear preservation time is 1-3 hours; in the stage of rolling, the rough rolling temperature is 900-1150° C., while the finish rolling temperature is 780-880° C.; in the stage of cooling, the steel is water cooled to below 400° C., then air cooled to the ambient temperature, wherein the speed of water cooling is more than or equal to 20° C./s; in the stage of tempering, the heating temperature is 100-400° C., and the heat preservation time is 30-120 min. The specific process parameters in Embodiments 1-10are shown in Table 2.

TABLE 1

Chemical Compositions in Embodiments 1-10 and in Contrastive Example 1 (wt %)

| | C | Si | Mn | P | S | Cr | Mo | Ni | Nb | V | Ti |
|---|---|---|---|---|---|---|---|---|---|---|---|
| Embodiment 1 | 0.33 | 0.50 | 1.50 | 0.015 | 0.005 | 1.20 | 0.21 | / | 0.016 | 0.060 | 0.019 |
| Embodiment 2 | 0.35 | 0.38 | 1.20 | 0.009 | 0.010 | 0.40 | 0.17 | 0.31 | 0.022 | 0.080 | 0.005 |
| Embodiment 3 | 0.36 | 0.45 | 1.05 | 0.008 | 0.004 | 0.32 | / | / | 0.080 | / | 0.020 |
| Embodiment 4 | 0.37 | 0.33 | 0.95 | 0.010 | 0.003 | / | 0.38 | / | / | / | 0.019 |
| Embodiment 5 | 0.38 | 0.25 | 0.91 | 0.009 | 0.003 | 0.28 | / | 1.50 | 0.045 | / | 0.040 |
| Embodiment 6 | 0.39 | 0.25 | 1.00 | 0.009 | 0.004 | 0.60 | 0.22 | / | 0.060 | / | / |
| Embodiment 7 | 0.41 | 0.31 | 0.85 | 0.007 | 0.003 | 0.38 | 0.10 | 0.58 | / | / | 0.050 |
| Embodiment 8 | 0.42 | 0.10 | 0.73 | 0.008 | 0.002 | 0.53 | 0.60 | / | 0.010 | 0.039 | 0.023 |
| Embodiment 9 | 0.44 | 0.23 | 0.50 | 0.008 | 0.003 | 1.0 | 0.80 | / | 0.021 | / | 0.015 |
| Embodiment 10 | 0.45 | 0.21 | 0.66 | 0.009 | 0.002 | / | 0.35 | 0.40 | 0.039 | / | 0.027 |
| Contrastive Example 1 | 0.52 | 0.8 | 0.51 | <0.024 | <0.03 | 4.2 | 0.5 | | — | 0.3 | — |

| | RE | W | Al | B | Ca | N | O | H |
|---|---|---|---|---|---|---|---|---|
| Embodiment 1 | 0.05 | 0.8 | 0.027 | 0.0005 | 0.0010 | 0.0042 | 0.0060 | 0.0004 |
| Embodiment 2 | / | / | 0.035 | 0.0020 | 0.0080 | 0.0080 | 0.0040 | 0.0002 |
| Embodiment 3 | 0.07 | / | 0.010 | 0.0040 | 0.0030 | 0.0050 | 0.0028 | 0.0002 |
| Embodiment 4 | / | / | 0.020 | 0.0015 | 0.0060 | 0.0028 | 0.0021 | 0.0003 |
| Embodiment 5 | / | / | 0.080 | 0.0013 | 0.0050 | 0.0038 | 0.0030 | 0.0003 |
| Embodiment 6 | / | 0.6 | 0.052 | 0.0012 | 0.0030 | 0.0029 | 0.0028 | 0.0002 |
| Embodiment 7 | / | / | 0.060 | 0.0016 | 0.0020 | 0.0035 | 0.0022 | 0.0002 |
| Embodiment 8 | / | / | 0.041 | 0.0013 | 0.0040 | 0.0032 | 0.0018 | 0.0002 |
| Embodiment 9 | 0.03 | / | 0.028 | 0.0015 | 0.0030 | 0.0028 | 0.0056 | 0.0003 |
| Embodiment 10 | / | / | 0.036 | 0.0012 | 0.0020 | 0.0038 | 0.0039 | 0.0002 |
| Contrastive Example 1 | 0.035 | — | — | — | — | — | — | — |

TABLE 2

| | Slab Heating Temp. ° C. | Heat Prev. Time h | Rough Rolling Temp. ° C. | Rough Rolling Deform. Rate % | Finish Rolling Temp. ° C. | Finish Rolling Deform. Rate % | Cooling Way | Cooling Speed ° C./s | Cease Cooling Temp. ° C. | Temper. Temp. ° C. | Heat Prev. Time min | Thickness of Steel Sheet mm |
|---|---|---|---|---|---|---|---|---|---|---|---|---|
| 1 | 1000 | 2 | 960 | 25 | 795 | 45 | water | 25 | 400 | / | / | 25 |
| 2 | 1120 | 2 | 1080 | 28 | 880 | 40 | water | 35 | 265 | / | / | 30 |
| 3 | 1100 | 2 | 1060 | 33 | 820 | 55 | water | 26 | 380 | / | / | 35 |
| 4 | 1080 | 2 | 1020 | 20 | 835 | 65 | water | 20 | 85 | / | / | 20 |
| 5 | 1100 | 2 | 1040 | 39 | 780 | 66 | water | 38 | 219 | / | / | 32 |
| 6 | 1130 | 2 | 1080 | 41 | 795 | 70 | water | 40 | 189 | / | / | 20 |
| 7 | 1140 | 3 | 1100 | 40 | 810 | 59 | water | 45 | 156 | 305 | 90 | 35 |
| 8 | 1150 | 3 | 1110 | 38 | 825 | 62 | water | 56 | Ambient Temp. | / | / | 28 |
| 9 | 1200 | 3 | 1150 | 50 | 836 | 69 | water | 70 | 205 | / | / | 26 |
| 10 | 1200 | 3 | 1200 | 36 | 826 | 59 | water | 50 | 165 | / | / | 29 |

1. Mechanical Property Test

The high-hardness low-alloy wear-resistant steel sheets in Embodiments 1-10 are tested for mechanical properties, and the results thereof are shown in Table 3.

TABLE 3

Mechanical Properties of Embodiments 1-10 and Contrastive Example 1

| | Hardness HB | Charpy V-notch Longitudinal Impact Energy (−40° C.), J |
|---|---|---|
| Embodiment 1 | 575 | 73 |
| Embodiment 2 | 586 | 71 |
| Embodiment 3 | 591 | 68 |
| Embodiment 4 | 599 | 65 |
| Embodiment 5 | 606 | 61 |
| Embodiment 6 | 612 | 58 |
| Embodiment 7 | 619 | 53 |
| Embodiment 8 | 624 | 49 |

TABLE 3-continued

Mechanical Properties of Embodiments 1-10 and Contrastive Example 1

| | Hardness HB | Charpy V-notch Longitudinal Impact Energy (−40° C.), J |
|---|---|---|
| Embodiment 9 | 628 | 46 |
| Embodiment 10 | 633 | 42 |
| Contrastive Example 1 | About 550 (HRC54) | — |

Seen from Table 3, the wear-resistant steel sheet in Embodiments 1-10 has a hardness of 570-640 HB, and −40□ Charpy V-notch longitudinal impact energy of 40-80 J, which indicates that the wear-resistant steel sheet of the present invention has high hardness and good impact toughness, and has excellent mechanical properties. The hardness of the steel sheet is higher than that of the contrastive steel sheet 1, and the impact toughness thereof is better than that of the contrastive steel sheet 1.

2. Wear Resistance Test

The wear resistance test is performed on ML-100 abrasive wear testing machine. When cutting out a sample, the axis of the sample is perpendicular to the steel sheet surface, and the wear surface of the sample is the rolled surface of the steel sheet. The sample is machined into a step-like cylinder body with a tested part of ϕ4 mm and a clamped part of ϕ5 mm. Before testing, the sample is rinsed by alcohol, and dried by a blower, then weighted on a scale with a precision of ten thousandth. The measured weight is taken as the original weight, then it is mounted onto an elastic clamp. The test is performed by an abrasive paper with 80 meshes, under an effect of a load 84N. After the test, due to the wear between the sample and the abrasive paper, a spiral line may be drawn on the abrasive paper by the sample. According to the start radius and end radius of the spiral line, the length of the spiral line is calculated out with the following formula:

$$S = \frac{\pi(r_1^2 - r_2^2)}{a}$$

wherein, r1 is the start radius of the spiral line; r2 is the end radius of the spiral line; a is the feed of the spiral line. In each test, weighting is performed for three times, and the average results are used. Then the weight loss is calculated, and the weight loss per meter indicates the wear rate of the sample (mg/M).

The wear resistance test is performed on the high-hardness high-toughness wear-resistant steel sheet in Embodiments 1-10 of the present invention. The wearing test results of the steel in these embodiments according to the present invention and the contrastive example 2 (in which a steel sheet with a hardness of 550HB is used) are shown in Table 4.

TABLE 4

Wearing Resistance Test Results of the Steel in Embodiments 1-10 and The Contrastive Example

| Steel Type | Test Temp. | Wearing Test Conditions | Wearing Rate (mg/M) |
|---|---|---|---|
| Embodiment 1 | Ambient Temp. | 80-grit abrasive paper/84 N load | 11.521 |
| Embodiment 2 | Ambient Temp. | 80-grit abrasive paper/84 N load | 11.462 |
| Embodiment 3 | Ambient Temp. | 80-grit abrasive paper/84 N load | 11.395 |
| Embodiment 4 | Ambient Temp. | 80-grit abrasive paper/84 N load | 11.332 |
| Embodiment 5 | Ambient Temp. | 80-grit abrasive paper/84 N load | 11.256 |
| Embodiment 6 | Ambient Temp. | 80-grit abrasive paper/84 N load | 11.188 |
| Embodiment 7 | Ambient Temp. | 80-grit abrasive paper/84 N load | 11.106 |
| Embodiment 8 | Ambient Temp. | 80-grit abrasive paper/84 N load | 11.037 |
| Embodiment 9 | Ambient Temp. | 80-rit abrasive paper/84 N load | 10.955 |
| Embodiment 10 | Ambient Temp. | 80-grit abrasive paper/84 N load | 10.901 |
| Contrastive example 2 | Ambient Temp. | 80-grit abrasive paper/84 N load | 11.995 |

It is known from Table 4 that in this wearing condition of ambient temperature and 80-meshes abrasive paper/84N load, the wearing performance of the high-hardness low-alloy wear-resistance according to the present invention is better than that of the contrastive example 2.

3. Microstructure

The microstructures are obtained by checking the wear-resistant steel sheet of Embodiment 7. As shown in FIG. 1, the microstructures are fine martensite and a trace of retained austenite, wherein the volume fraction of the retained austenite is less than or equal to 5%, which ensures that the steel sheet has excellent mechanical properties.

The present invention, under the reasonable conditions of production process, designs scientifically the compositions of carbon and alloy elements, and the ratios thereof, reducing the cost of alloys; and makes full use of TMCP processes to refine and strengthen the structures, such that the obtained wear-resistant steel sheet has high hardness, good impact toughness and excellent wear resistance, and fine applicability.

What is claimed is:

1. A wear-resistant steel sheet consisting of:

a) greater than 0.33% to less than or equal to 0.37 wt % carbon (C):
b) 0.33-0.50 wt % silicon (Si);
c) 0.95-1.50 wt % manganese (Mn);
d) 0.0005-0.0040 wt % boron (B);
e) less than or equal to 1.50 wt % chromium (Cr);
f) 0.17-0.80 wt % molybdenum (Mo);
g) 0.31-2.00 wt % nickel (Ni);
h) greater than 0% to less than or equal to 0.080 wt % niobium (Nb);
i) greater than 0% to less than or equal to 0.080 wt % vanadium (V);
j) less than or equal to 0.060 wt % titanium (Ti);
k) less than or equal to 0.10 wt % rare earth (RE);
l) greater than 0% to less than or equal to 1.00 wt % tungsten (W);
m) 0.010-0.080 wt % aluminum (Al);
n) 0.0010-0.0080 wt % calcium (Ca);
o) less than or equal to 0.0080 wt % nitrogen (N);
p) less than or equal to 0.0080 wt % oxygen (O);
q) less than or equal to 0.0004 wt % hydrogen (H);
r) less than or equal to 0.015 wt % phosphorus (P);
s) less than or equal to 0.010 wt % sulfur (S);
t) 0.20-0.50 wt % (Cr/5+Mn/6+50B)
u) 0.02-0.50 wt % (Mo/3+Ni/5+2Nb)
v) 0.01-0.13 wt%(Al+Ti)
w) a remainder of iron (Fe) and other unavoidable impurities;

wherein the steel sheet comprises microstructures of martensite and retained austenite, a hardness of equal to or more than 575 HB, and a Charpy V-notch longitudinal impact energy of equal to or more than 65 J as measured at −40° C.

2. The steel sheet according to claim 1, wherein carbon: 0.35-0.37 wt %; and silicon: 0.33-0.40 wt %.

3. The steel sheet according to claim 1, wherein manganese: 0.95-1.20 wt %; chromium: 0.10-1.30 wt %; molybdenum: 0.17-0.60 wt %; nickel: 0.31-1.50 wt %; and (Mo/3+Ni/5+2Nb): between 0.04-0.45 wt %.

4. The steel sheet according to claim 1, wherein niobium: 0.005-0.080 wt %; vanadium: less than or equal to 0.060 wt %; rare earth: less than or equal to 0.080 wt %; and tungsten: less than or equal to 0.80 wt %.

5. The steel sheet according to claim 1, wherein boron: 0.0005-0.0020 wt %; calcium: 0.0010%-0.0060 wt %; and (Cr/5+Mn/6+50B) between 0.20-0.45 wt %.

6. The steel sheet according to claim 1, wherein nitrogen: less than or equal to 0.0050 wt %; oxygen: less than or equal to 0.0050 wt %; hydrogen: less than or equal to 0.0003 wt %; phosphorus: less than or equal to 0.012 wt %; and sulfur: less than or equal to 0.005 wt %.

7. The steel sheet of claim 1, wherein aluminum: 0.020-0.080 wt %; titanium: 0.005-0.060 wt %; and (Al+Ti): between 0.01-0.12 wt %.

8. A method of manufacturing the wear-resistant steel sheet according to claim 1, the method comprising:

a) smelting the elements of claim 1 to yield a smelted material;

b) casting the smelted material;

c) heating the casted material to a slab heating temperature of 1000-1200° C. for a heat preservation time ranging from 1-3 hours;

d) rolling the heated material at a rough rolling temperature of 900-1150° C. and a finish rolling temperature is 780-880° C.; and e) cooling the rolled material directly after rolling by water cooling the material to below 400° C. at a speed greater than or equal to 20° C./s, then air cooling the material to ambient temperature to obtain the wear-resistant steel sheet; wherein the resultant steel sheet comprises microstructures of martensite and retained austenite, wherein the volume fraction of the retained austenite is less than or equal to 5%;

wherein the wear-resistant steel sheet according to claim 1 is produced and the resultant steel sheet exhibits a hardness of more than 575 HB, and a Charpy V-notch longitudinal impact energy of more than 65 J as measured at −40° C.

9. The method of claim 8, further comprising tempering the cooled material at a heating temperature of 100-400° C. for a heat preservation time of 30-120 min.

10. The method of claim 8, wherein the slab heating temperature is 1000-1150° C.

11. The method of claim 8, wherein the rough rolling temperature is 900-1100° C., and the reduction rate during rough rolling is more than 20%; and wherein the finish rolling temperature is 780-860° C., and the reduction rate during finish rolling is more than 40%.

12. The method of claim 8, wherein the water cooling temperature is below 380° C., and the water cooling speed is greater than or equal to 23° C./s.

13. The method of claim 9, wherein the tempering temperature is 100-380° C., and the heat preservation time is 30-100 min.

* * * * *